United States Patent [19]

Jackson

[11] Patent Number: 4,706,957

[45] Date of Patent: Nov. 17, 1987

[54] LEG MOVEMENT RESTRAINING DEVICE FOR TRAINING ATHLETES

[76] Inventor: Charleston W. Jackson, 2214 W. Heatherbrae #2, Phoenix, Ariz. 85015

[21] Appl. No.: 863,723

[22] Filed: May 16, 1986

[51] Int. Cl.[4] ..... A63B 69/36

[52] U.S. Cl. ..... 273/188 R; 434/253

[58] Field of Search ..... 273/188 R, 188 A, 189 R, 273/189 A, 190 R, 190 A, 190 B, 190 C, 183 B; 128/80 R; 272/97; 434/253

[56] References Cited

U.S. PATENT DOCUMENTS 2,450,162 9/1948 Promen ..... 273/188 R

*Primary Examiner*—George J. Marlo

*Attorney, Agent, or Firm*—Gregory J. Nelson

[57] ABSTRACT

An athletic training device for restraining an athlete's legs in a proper position throughout a predetermined range of physical motions to reinforce the desired motion through repetitive practice. The training device includes a first elasticized or knee-encircling band having at least one pair of laterally extending straps. A second elasticized knee-encircling band is adapted to be secured about the opposite knee of the user. The ends of the restraining straps are securable to the second band so that the user is restrained in a proper position allowing forward and rearward motion of the knees restraining undesirable sideways motion or sway.

7 Claims, 8 Drawing Figures

LEG MOVEMENT RESTRAINING DEVICE FOR TRAINING ATHLETES

The present invention relates to an athletic training device and more particularly relates to a restraint device for supporting and restraining the legs of the user in a proper relationship to reinforce desired body movements through forced repetition of a particular movement or series of movements.

Various athletic endeavors require certain specific body movements for optimum performance. For example, a proper golf swing requires a precise combination of grip, stance and body movement. The coordination of these elements require the golfer to utilize the arms, hands, body and legs in a proper manner from the backswing through the follow-through to provide the proper shot with accuracy and power. A common error made by many golfers is during the backswing or take-away, the golfer tends to move to one side throwing the golfer off balance. During the swing many golfers also tend to raise their feet rather than pivoting and maintaining a proper position over the ball. This movement greatly reduces the effectiveness of the golfer in that the golfer's swaying movement will position the golfer out of the proper hitting zone which is a position with the feet in a stance approximating the width of the shoulders and in which the head remains substantially immobile during the golf swing. Side motion and lifting of the feet also results in loss of power and loss of accuracy of the golf shot.

Other athletic endeavors similarly require specific body movement for correct and successful execution. For example, proper skiing technique requires unweighting of the skis and a shifting of the skier's weight to the downhill ski when executing a turn. When done properly, body movement is limited and the knees and lower legs work together in unison to execute a "carved" turn.

Various devices can be found in the prior art for teaching proper rhythm, leg movement and weight shift. By and large these devices are training devices to be used by golfers during practice. For example, U.S. Pat. No. 2,450,162 shows a golf practice device having a pair of loops which are interconnected and adapted to hold a golfer's arms in proper relationship during practice.

U.S. Pat. No. 4,239,228 shows an improvement over U.S. Pat. No. 2,450,162 in which an adjustable tether is provided for joining the upper arms of the golfer. Mating loop and hook fasteners are used for the loops and for the interconnecting strap members.

The above devices relate primarily to tethers for joining the arms. U.S. Pat. No. 1,677,728 shows a rehabilitation device in which an elastic cord connects between the feet or legs of the wearer.

U.S. Pat. No. 4,088,326 discloses a golf practice device for securing the golfer's knees in proper relationship throughout the swing of the golf club. The device includes two knee-engaging members connected by a flexible cord. Each of the knee-engaging members includes straps which wrap about the golfer's legs and are attached to a rigid plate.

While the above devices have met with some success in the past, they generally are not effective to meet the requirements of today's techniques for the modern athlete such as the golfer since these devices do not serve to control movement of the legs and knees in a forward and backward movement which is now known to be of great importance in total balance and pivoting. Generally these devices which are attachable to the legs restrict or restrain the user from moving the legs apart. These devices many times do not effectively teach the golfer proper body movements and actually encourage side-to-side sway. This seriously handicaps the golfer in that the golfer will be out of the proper hitting zone when playing golf and will tend to acquire improper body movements causing the user to become less, rather than more effective in achieving the desired and proper motion and performance. The same problems exist with training devices for other sports such as skiing.

Accordingly, there exists a need in the art for an athletic training device which will positively reinforce through repetition the component motions of a correct movement for a particular athletic endeavor such as golf or skiing.

Briefly, the present invention provides a training and support device consisting of a first knee-encircling, flexible restraint which is attachable about the knee area of one leg. At least one pair of flexible restraining straps or belts extend from the first knee-encircling member and are securable either to one another or at the exterior of a second knee-encircling flexible restraint member secured at the opposite knee of the user. The device stabilizes the user's legs and reinforces a backward and forward leg motion through repetitive use. The staps and the knee-encircling restraint members are preferably securable at loop and hook fabric fasteners providing the user with flexibility in the position and relationship in which the knees are flexibly restrained. The device also accomodates a variety of physical variations in the anatomy of the user.

With the stabilizer training device of the present invention, the support straps are placed just above the knees and just below the knees for balance. When utilized as a golf training device, it forces the golfer to maintain a proper flat-footed position during the address and take-away. Importantly, the device of the present invention causes the golfer to move his knees in a forward and backward motion maintaining a balanced stance, not allowing either foot to be raised during the swing. The device is designed to be worn during practice periods or during actual participation of the sport until the desired movement has, through repetition, become learned. Once the proper movement is learned through repetition, the muscular system will respond naturally and the movement will be imparted during participation when the retainer is not being worn.

It is accordingly a principal object of the present invention to provide a new and improved physical training device.

Another object of the present invention is to provide a training device which comprises a restraining system for maintaining the relative spacing between the legs of the user and which forces the user to move the knees in a controlled forward and backward motion.

It is still another object of the present invention to provide a training device which is readily adjustable to accomodate users of different physical sizes and shapes and which is readily and easily adjustable.

It is still another object of the present invention to provide a training device which will stabilize or balance the user and force the user through repetition to learn a proper body movement and to maintain the body movement to improve physical performance.

The above and other objects and advantages of the present invention will become more apparent from the following description, claims, and drawings in which:

Figure 3:
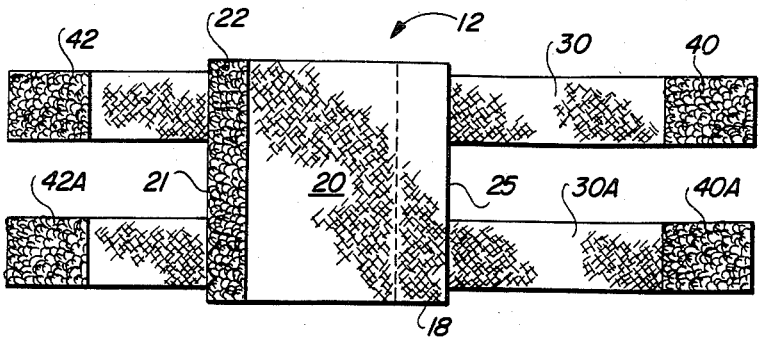
FIG. 3 is a planar view of the inside of one of the knee-encircling members and associated straps.
Figure 4:
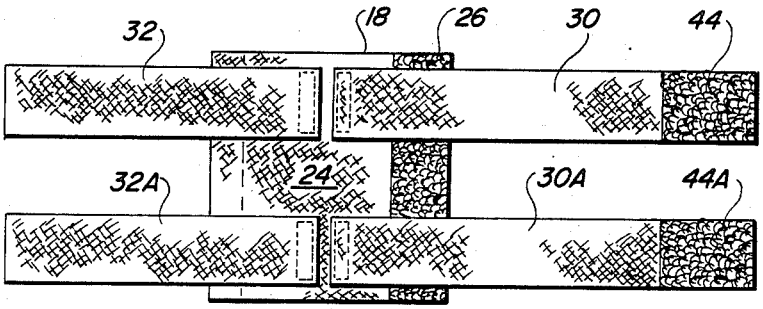
FIG. 4 is a planar view of the outer side of the encircling member shown in FIG. 3.
Figure 5:
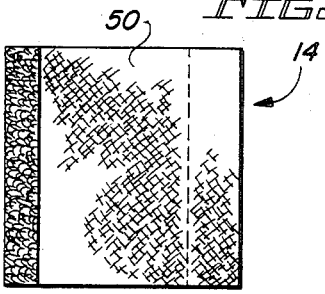
FIG. 5 is a planar view of the inside of the opposite knee-encircling member.
Figure 6:
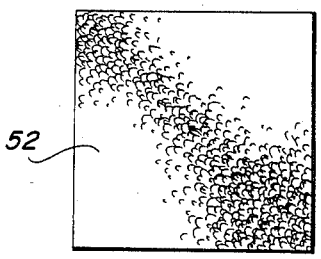
FIG. 6 is a planar view of the outer surface of the knee-encircling member shown in FIG. 5.

Turning now to the drawings, the training device of the present invention is generally designated by the numeral 10 and consists of a first knee-encircling member 12 as best seen in FIGS. 3 and 4 and a second knee-encircling member 14 as best shown in FIGS. 5 and 6.

The first knee-encircling member 12 includes a band 18 which is shown as being generally rectangular and is fabricated from a suitable flexible material such as an elasticized cotton webbing or the like similar to the material used for knee braces of the type commonly used by athletes. The band 18 has an overall height sufficient so that it extends on most users from an area above the patellae to an area below the patellae encompassing the entire knee area from the lower end of the femur to the upper end of the fibia. The band 18 has a transverse width sufficient so that it will completely encircle the knee area of the user in overlapping fashion.

The inner surface 20 of the band is provided with a section 22 of separable fastener material which extends vertically along edge 21 of the band. The outer surface 24 of the band 18, as seen in FIG. 4, is provided with a cooperating section 26 of separable fastener material along edge 25 so that when the band 18 is placed about one knee of the user with edge 21 overlapping edge 25, the cooperable fastener sections 22 and 26 may be engaged so that the band snugly and comfortably fits about the knee area. The transverse width of each of the cooperating fastener sections 22 and 26 is sufficiently generous to accomodate variations in girth and physical configuration of the knee area of the user. The separable fastener elements employed in the preferred embodiment are well-known and are of the hook and loop type fastener sold under the trademark Velcro and for convenience are referred to as first and second element separable fasteners or closures.

As shown in FIGS. 3 and 4, one or more pairs of oppositely extending support straps 30, 32 and 30A, 32A are secured to the outer surface 24 of the band. The straps may be formed of any suitable material such as cotton webbing, leather or plastic. Preferably there are two pairs of straps as shown. Straps 30 and 30A are secured by stitching to the band with strap 30 being positioned adjacent the upper edge of the band 20 and the strap 30A being stitched adjacent the lower edge of the band and extending laterally from the band. The outer end of the inner side of straps 30 and 30A is provided with a first element 40 and 40A, respectively, of a two-component separable fastener member. The other or second element of the two-element fastener is secured to the outer surface of the opposite knee-encircling band 14 as will be explained in greater detail hereafter and is shown in FIG. 6. Similarly, the outer ends of the inner sides of belts 32 and 32A are also provided with the first element of a two-element separable fastener member, respectively designated 42 and 42A. The outer ends of the outer sides of belts 30 and 30A are provided with fastener sections 44 and 44A, respectively, which are the second element of the mating loops and hook fastener assembly.

The second or opposite knee-encircling band designated by the numeral 14 is shown in FIGS. 5 and 6. Band member 14 is again generally rectangular being fabricated of a suitable elasticized material. Band 14 is adapted to comfortably encircle the opposite knee of the user and to this end is provided with a first separable fastener section 48 extending along one vertical edge of the band on the inner side 50. A substantial portion of the outer surface of band 14 is provided with the second element of a separable fastener member 52. Accordingly, when the band 50 is placed about the knee area of the user, fastener elements 48 and 52 will cooperate to secure the band about the knee of the user in accordance with the particular physical requirements of the individual user.

The present invention will be more fully understood from the following description of use of the invention as a golf training device. As pointed out above, golf training is only one particular application and the device may be used for training proper movement for a variety of activities.

Figure 7:
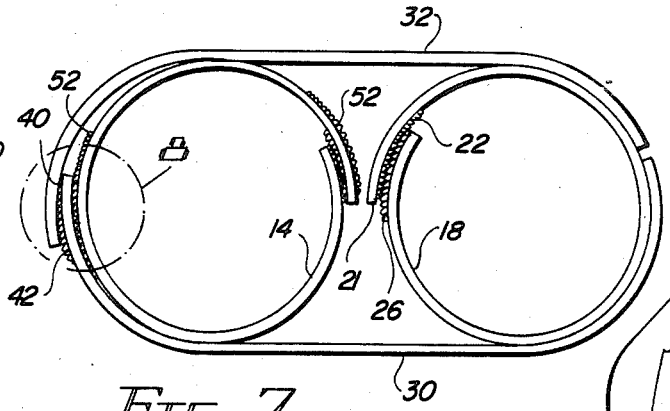
FIG. 7 is a top view of the training device secured in a position of use.

In use, referring to FIG. 7, the first knee-encircling band 20 is placed about the knee area on one leg of the user. The band 20 is secured about the knee and the separable fastener portions 22 and 26 are overlapped at the inside of the knee and engaged so that the band firmly but comfortably engages the knee area. The opposite knee-encircling band 50 is placed about the opposite knee in a knee-encircling position. The separable fastener portion 48 is engaged against the cooperable second fastener section 52 on the outer surface of the band at a location at the inside of the knee. In the same manner as band 20, band 50 is snugly but comfortably secured in position. The user then assumes the proper stance. In the case of golf, the proper stance is with the feet firmly on the surface and the feet spaced apart a distance, generally corresponding to the shoulder width of the user. Straps 30 and 32 are then extended from the first knee, around the second knee and secured at their outer ends and to the outer surface 52 of the knee band 50. The cooperating separable fastener members provide for adjustability and accomodate different physical size users. The second or lower set of straps, 30A and 32A are similarly secured immediately below the petallae. It will be seen that in this manner that the straps 30, 32, 30A, 32A restrain the legs in a manner to restrict side movement or pulling apart of the knees. However, the individual knee bands 20 and 50 both being flexible allow the knee area to bend in a natural forward and backward motion. Straps 32, 32A may be secured either to the outside of straps 30, 30A, respectively, at fastener sections 40, 40A or may be attached directly to the fastener material 52 depending on the particular position and physical configuration of the user. It is preferred that the area of attachment of the straps to the bands be at the sides of the knee areas to minimize restriction with forward and rearward leg motion.

Figure 1:
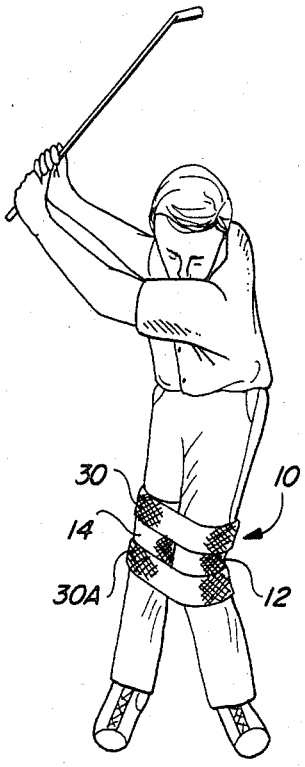
FIG. 1 is a pictorial view showing the training device of the present invention in a position of use on a golfer with the golf club at the top of the backswing.

FIG. 1 illustrates the position of a golfer at the top of the backswing. It is noted that the left knee of the golfer is slightly bent. The upper and lower support straps are positioned just above and just below the kness to stabilize and force the golfer to maintain a substantially flat-footed position during the take-away and address to the ball. Further, the device forces the golfer to move his knees in forward and backward motion maintaining a balanced stance not allowing either foot to be raised during the swing. The head remains squarely positioned over the ball throughout the swing. Side motion and sway is minimized.

Figure 2:
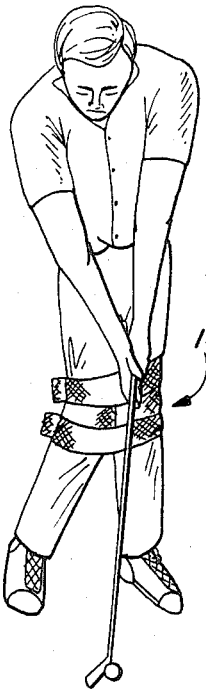
FIG. 2 is a view similar to FIG. 1 with the golfer being shown in a hitting position about to impact the golf ball.

In FIG. 2, the golfer is shown at the point of impact of the ball. In this position, the leg position has been changed as the right leg has moved forward during the downswing until the point of impact is shown in FIG. 2. Again, the motion reinforced through use of the device is a forward and rearward movement and side-sway is minimized. The golfer's head remains squarely over the ball and the golfer is in a solid balanced position.

The golfer practices his swing repetitively using the device of the present invention and such repetitive practice will create "muscle memory" until the proper motion is learned and this motion will naturally occur even when the device is not worn. Thus, the device of the present invention is designed to control an athletes balance through repetitional practices. When used as a golf practicing aid, the device will teach the golfer how to swing for better control and balance. Further, the device will minimize unnecessary or unwanted movement so that the golfer is in the proper position when the ball is struck.

FIG. 7 illustrates the device secured in a position of use. As explained above, the outer ends of the retaining straps are provided with cooperable fastening members which are securable either to the outer surface of the opposite knee-brace or to one another. It is within the scope of the present invention to provide cooperating separable fastener members on the ends of straps 30, 32 and 30A, 32A which permit the straps to be joined directly together. However, for most exercises it is preferred that the straps be secured to the outer surface of knee member 52 as shown in FIG. 7 for greater flexibility.

Figure 8:
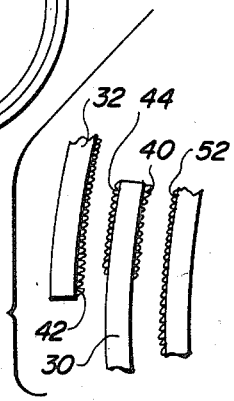
FIG. 8 is a detail view of a portion of the training device as indicated in FIG. 7.

FIG. 8 illustrates the end of the straps 30 and 32 and the fastener portion on knee-encircling member 14 with strap members overlapping at the lateral or outer side of the knee.

Although the description of the preferred embodiment has been made with reference to a specific device for golfing, it is contemplated that various changes, alterations and modifications may be made to the device without deviating from the spirit and scope of the appended claims. Accordingly, to the extent that these alterations, modifications and changes do not depart from the spirit and scope of the appended claims, they are intended to be encompassed therein.

I claim:

1. A training aid for teaching a predetermined physical motion comprising:

(a) a first leg-engaging member having a first band adapted to encircle a first knee of the user, said first band having cooperating closures for securing said band about the first knee area of the user and further including straps oppositely extending from said band, said straps having first fastener members associated therewith; and (b) a second leg-engaging member having a second band adapted to encircle the second knee of the user, said second band having with cooperating closures for securing said band about the second knee area of the user, said second leg-engaging member having a second fastener member associated therewith for attachment of said straps thereto in a use position with the straps extending between the leg-engaging members both at the front and the rear of the knees of the user, whereby controlled forward and rearward movement of the user's legs is permitted and side motion is restrained.

2. The training aid of claim 1 wherein said first and second fastener members comprises cooperable loop and hook fabric members.

3. The training aid of claim 2 wherein said second fastener member is located on said outer surface of said second knee-encircling band at a location along the side of the knee.

4. The training aid of claim 2 wherein said cooperating closure members comprise loop and hook fabric members.

5. The training aid of claim 2 wherein said second band member is provided with multiple straps at spaced apart locations on said first leg-engaging members.

6. The training aid of claim 2 wherein said first and second bands are an elasticized fabric material.

7. The training aid of claim 6 wherein said second fastener member is located on the outer surface of said second knee-encircling band at a location along the side of the knee wherein said straps at least partially overlap in a fastened position of use.

* * * * *